US005855306A

United States Patent [19]

Masak

[11] Patent Number: 5,855,306

[45] Date of Patent: Jan. 5, 1999

[54] ARTICLE CARRIER STRAP APPARATUS

[76] Inventor: Mark P. Masak, PO Box 298, Buffalo, N.Y. 14220

[21] Appl. No.: 762,329

[22] Filed: Dec. 9, 1996

[51] Int. Cl.[6] ..... A45F 3/14

[52] U.S. Cl. ..... 224/250; 224/257; 224/600; 224/603; 224/604; 224/605; 224/673; 224/674; 224/150

[58] Field of Search ..... 224/250, 257, 224/255, 600, 601, 602, 603, 604, 605, 673, 674, 917, 901.4; 294/150

[56] References Cited

U.S. PATENT DOCUMENTS

| | | | |
|---|---|---|---|
| D. 335,576 | 5/1993 | Phillpott | D3/36 |
| 4,483,470 | 11/1984 | Cousins | 224/257 |
| 4,518,107 | 5/1985 | Amos | 224/215 |
| 4,629,103 | 12/1986 | Miller | 224/257 |
| 4,790,462 | 12/1988 | Kawaguchi | 224/250 |
| 4,863,083 | 9/1989 | Chen | 224/226 |
| 4,867,359 | 9/1989 | Donovan | 224/250 |
| 5,016,797 | 5/1991 | Rowledge | 224/257 |
| 5,083,692 | 1/1992 | Treese | 224/250 |
| 5,285,939 | 2/1994 | Hogan | 224/250 |
| 5,505,353 | 4/1996 | Marsh, Jr. | 224/250 |
| 5,642,842 | 7/1997 | Taras | 224/250 |

FOREIGN PATENT DOCUMENTS

| | | | |
|---|---|---|---|
| 2577123 | 8/1986 | France | 224/917 |
| 167201 | 2/1934 | Switzerland | 224/917 |

*Primary Examiner*—David J. Walczak
*Assistant Examiner*—Timothy L. Maust

[57] ABSTRACT

An article carrier strap apparatus includes an article-engaging strap assembly which includes a first article-engaging-strap end, a first article-engaging-strap connector attached to the first article-engaging-strap end, a second article-engaging-strap end, a second article-engaging-strap connector connected to the second article-engaging-strap end, a middle article-engaging-strap portion located between the first article-engaging-strap end and the second article-engaging-strap end, and a first strap-length adjustment assembly located in the middle article-engaging-strap portion. A support strap assembly supports the article-engaging strap assembly. The support strap assembly includes a closed, support-loop portion for supporting the middle article-engaging-strap portion of the article-engaging strap assembly and includes a user-supported portion connected to the closed, support-loop portion. In one embodiment, the user-supported portion includes a closed, handle-loop connected to the closed, support-loop portion. In another embodiment, the user-supported portion of the support strap assembly includes an adjustable-length, support-loop-portion-supporting assembly. The adjustable-length, support-loop-portion-supporting assembly can be used in the mode of a shoulder strap and can be used in the mode of a hands-free manner in which both of a wearer's shoulders are used.

5 Claims, 3 Drawing Sheets

FIG 1
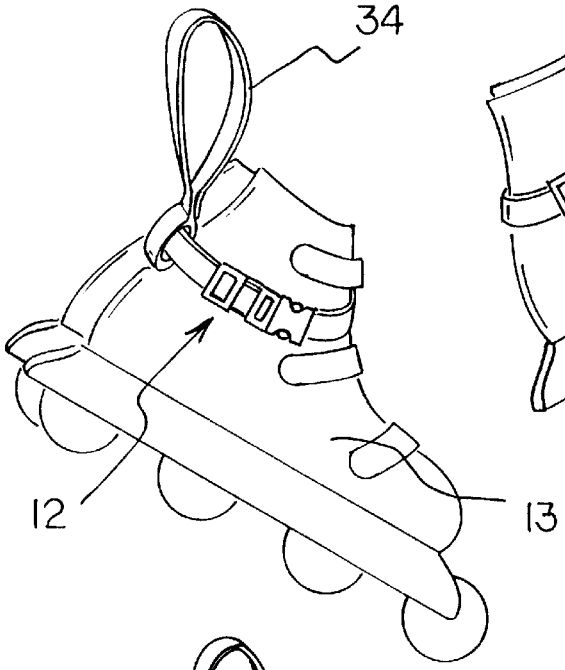
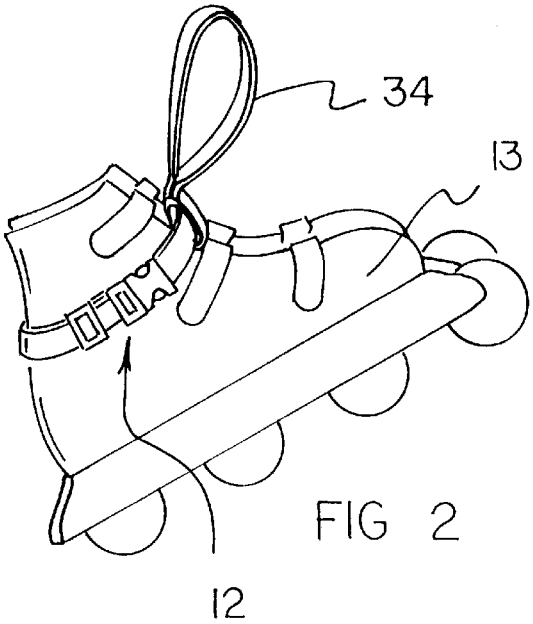
FIG 2
FIG 3
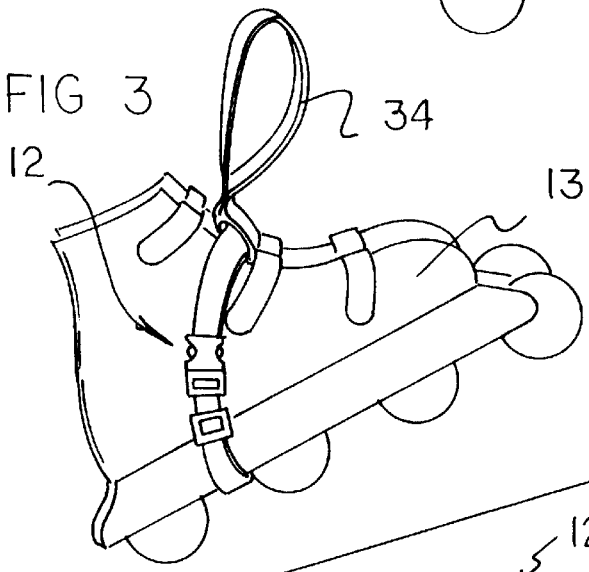
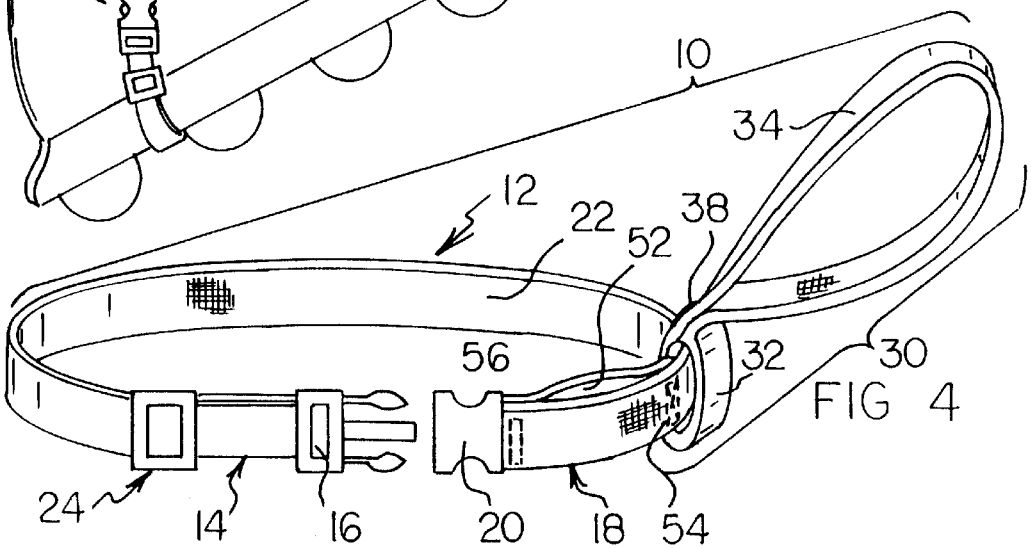
FIG 4

50
35
48
30
32
12
48
50
44
46
42
40

60
12
22
52
24
16
20
32

FIG 7
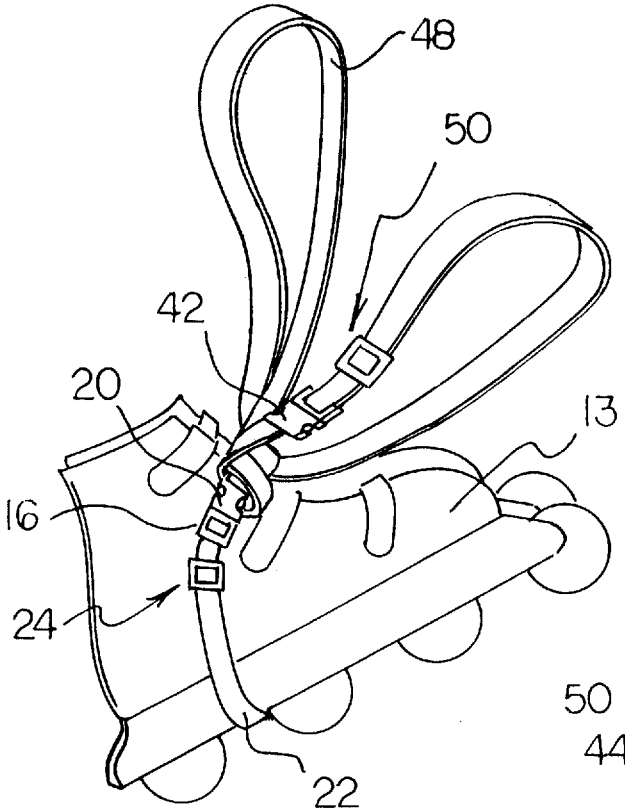
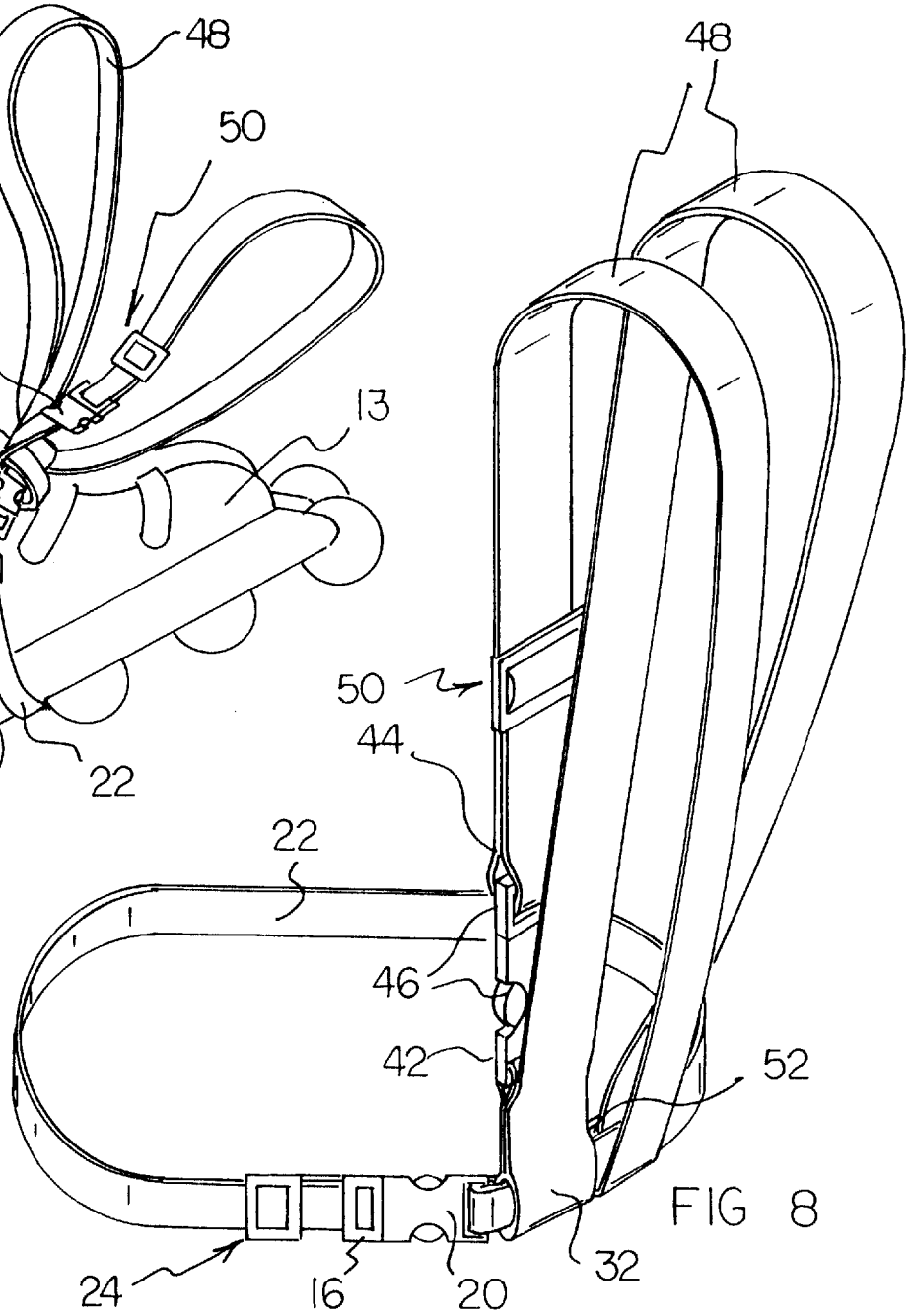
FIG 8

ARTICLE CARRIER STRAP APPARATUS

BACKGROUND OF THE INVENTION

1. Field of the Invention

The present invention relates generally to article carriers and, more particularly, to article carriers that employ flexible straps.

2. Description of the Prior Art

Throughout the years, a number of innovations have been developed relating to article carriers that employ flexible straps, and the following U.S. patents are representative of some of those innovations: 4,483,470, 4,518,107, 4,790,462, 4,863,083, 5,016,797, and Des. 335,576. More specifically, each of U.S. Pat. Nos. 4,483,470, 4,790,462, and Des. 335,576 discloses a strap device for carrying footwear. Even more specifically, U.S. Pat. No. 4,483,470 discloses a sling type strap that has two open ends. One roller skate is attached to each of the two open ends. Using this device one skate hangs over the front of a wearer and another skate hangs over the back of the wearer. There may be times, however, when a person desires to carry a pair of skates placed side by side, rather than straddling the front and back of the person. In this respect, it would be desirable if a strap-based article carrier were provided which permits a pair of footwear to be carried side by side.

U.S. Pat. No. 4,790,462 discloses a boot carrier that employs straps, wherein each boot of a pair is carried in an individual carrier. A carrier strap is slung over a wearer's neck, and the boots are carried side by side. However, because each boot is carried in an individual boot carrier, each boot can swing independently of the other boot. As a result, it may be difficult for a wearer to control two independently swinging boots. In this respect, it would be desirable if a strap-based article carrier were provided which binds a pair of footwear together so that each of the pair of footwear does not swing independently of the other.

U.S. Pat. No. Des. 335,576 discloses a skate sling carrier which has two skate-carrier loops, wherein each of a pair of skates is carried in an individual skate-carrier loop. As a result, each of the pair of skates is not bound to the other skate. Moreover, the independently hung skates are located at the far end of a straight strap. Because the skates are located at the far end of a straight strap, there may be a tendency for each of the pair of skates to swing in a pendulum type fashion at the end of the strap. To avoid such a double pendulum type swinging action of carried articles, it would be desirable if a strap-based article carrier were provided which does not include a pair of individual skate-carrier loops located at the far end of a straight strap.

Among the patents cited hereinabove, U.S. Pat. Nos. 4,518,107, 4,863,083, and 5,016,797 may also be of interest for there disclosure of additional strap-based article carriers. U.S. Pat. No. 4,518,107 discloses a carrier system for ski equipment. U.S. Pat. No. 4,863,083 discloses a waist belt that is used for carrying skis and boots. U.S. Pat. No. 5,016,797 discloses an article carrier used for carrying cameras and binoculars.

Other features would be desirable in an article carrier strap apparatus. For example, there may be times when it would be desirable for a person to carry articles by using one's hand. There may be other times when a person may desire to carry articles using a one's shoulder. In addition, there may be still other times when a person may desire to carry articles in a hands-free manner, such as being carried on one's back. In this respect, it would be desirable if a strap-based article carrier were provided that optionally could be used for carrying articles by hand, for carrying articles using one's shoulder, and for carrying articles in a hands-free manner.

Thus, while the foregoing body of prior art indicates it to be well known to use strap-based article carriers, the prior art described above does not teach or suggest an article carrier strap apparatus which has the following combination of desirable features: (1) permits a pair of footwear to be carried side by side; (2) binds a pair of footwear together so that each of the pair of footwear does not swing independently of the other; (3) does not include a pair of individual skate-carrier loops located at the far end of a straight strap; and (4) optionally can be used for carrying articles by hand, for carrying articles using one's shoulder, and for carrying articles in a hands-free manner. The foregoing desired characteristics are provided by the unique article carrier strap apparatus of the present invention as will be made apparent from the following description thereof. Other advantages of the present invention over the prior art also will be rendered evident.

SUMMARY OF THE INVENTION

To achieve the foregoing and other advantages, the present invention, briefly described, provides an article carrier strap apparatus which includes an article-engaging strap assembly which includes a first article-engaging-strap end, a first article-engaging-strap connector attached to the first article-engaging-strap end, a second article-engaging-strap end, a second article-engaging-strap connector connected to the second article-engaging-strap end, a middle article-engaging-strap portion located between the first article-engaging-strap end and the second article-engaging-strap end, and a first strap-length adjustment assembly located in the middle article-engaging-strap portion. A support strap assembly supports the article-engaging strap assembly. The support strap assembly includes a closed, support-loop portion for supporting the middle article-engaging-strap portion of the article-engaging strap assembly and includes a user-supported portion connected to the closed, support-loop portion. The user-supported portion includes a closed, handle-loop connected to the closed, support-loop portion.

The user-supported portion of the support strap assembly includes an adjustable-length, support-loop-portion-supporting assembly. The adjustable-length, support-loop-portion-supporting assembly includes a first closed-support-loop-portion supporting end, a first support-loop connector attached to the first closed-support-loop-portion supporting end, a second closed-support-loop-portion supporting end, a second support-loop connector connected to the second closed-support-loop-portion supporting end, a middle closed-support-loop-portion supporting strap portion located between the first closed-support-loop-portion supporting end and the second closed-support-loop-portion supporting end, and a strap-length adjustment assembly located in the middle closed-support-loop-portion supporting strap portion.

In addition, the middle article-engaging-strap portion of the article-engaging strap assembly can include a slot portion. The slot portion is located adjacent to either the first article-engaging-strap connector or to the second article-engaging-strap connector.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining at least two preferred embodiments of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

It is therefore an object of the present invention to provide a new and improved article carrier strap apparatus which has all of the advantages of the prior art and none of the disadvantages.

It is another object of the present invention to provide a new and improved article carrier strap apparatus which may be easily and efficiently manufactured and marketed.

It is a further object of the present invention to provide a new and improved article carrier strap apparatus which is of durable and reliable construction.

An even further object of the present invention is to provide a new and improved article carrier strap apparatus which is susceptible of a low cost of manufacture with regard to both materials and labor, and which accordingly is then susceptible of low prices of sale to the consuming public, thereby making such article carrier strap apparatus available to the buying public.

Still yet a further object of the present invention is to provide a new and improved article carrier strap apparatus which permits a pair of footwear to be carried side by side.

Still another object of the present invention is to provide a new and improved article carrier strap apparatus that binds a pair of footwear together so that each of the pair of footwear does not swing independently of the other.

Yet another object of the present invention is to provide a new and improved article carrier strap apparatus which does not include a pair of individual skate-carrier loops located at the far end of a straight strap.

Even another object of the present invention is to provide a new and improved article carrier strap apparatus that optionally can be used for carrying articles by hand, for carrying articles using one's shoulder, and for carrying articles in a hands-free manner.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein:

FIG. 1 is a perspective view showing a first embodiment of the article carrier strap apparatus of the invention being used with a hand strap to carry a pair of roller blade skates from a rear portion of the skates, wherein a binding strap binds top ankle portions of the skates together.

FIG. 2 is a perspective view showing the embodiment of the invention shown in FIG. 1 for carrying a pair of roller blade skates from a front portion of the skates, wherein a binding strap binds top ankle portions of the skates together.

FIG. 3 is a perspective view showing the embodiment of the invention shown in FIG. 1 for carrying a pair of roller blade skates from a front portion of the skates, wherein a binding strap binds top and bottom portions of the skates together.

FIG. 4 is an enlarged perspective view of the embodiment of the invention shown in FIGS. 1–3 removed from the pair of skates.

FIG. 7 is a perspective view showing the second embodiment of the article carrier strap apparatus of the invention being used as a hands-free strap to carry a pair of roller blade skates from a front portion of the skates, wherein a binding strap binds top and bottom portions of the skates together.

FIG. 8 is an enlarged perspective view of the embodiment of the invention shown in FIG. 7 removed from the pair of skates.

DESCRIPTION OF THE PREFERRED EMBODIMENT

Figures 5, 6:
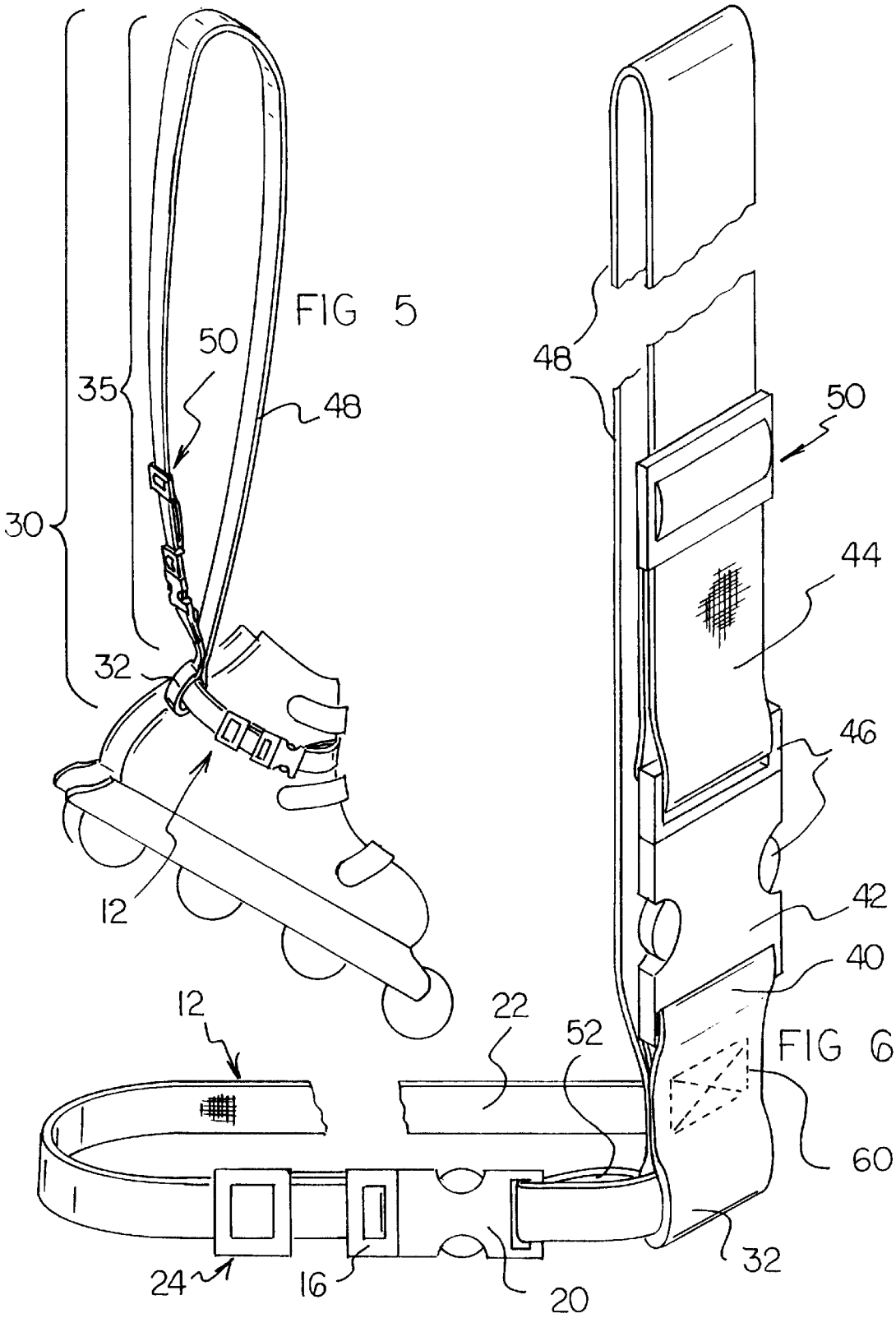
FIG. 5 is a perspective view showing a second embodiment of the article carrier strap apparatus of the invention being used as a shoulder strap to carry a pair of roller blade skates from a rear portion of the skates, wherein a binding strap binds top ankle portions of the skates together.
FIG. 6 is an enlarged perspective view of the embodiment of the invention shown in FIG. 5 removed from the pair of skates.

With reference to the drawings, embodiments of a new and improved article carrier strap apparatus embodying the principles and concepts of the present invention will be described.

Generally, each of the article carrier strap apparatuses of the invention includes an article-engaging strap assembly 12 which includes a first article-engaging-strap end 14, a first article-engaging-strap connector 16 attached to the first article-engaging-strap end 14, a second article-engaging-strap end 18, a second article-engaging-strap connector 20 connected to the second article-engaging-strap end 18, a middle article-engaging-strap portion 22 located between the first article-engaging-strap end 14 and the second article-engaging-strap end 18, and a first strap-length adjustment assembly 24 located in the middle article-engaging-strap portion 22. A support strap assembly 30 supports the article-engaging strap assembly 12. The support strap assembly 30 includes a closed, support-loop portion 32 for supporting the middle article-engaging-strap portion 22 of the article-engaging strap assembly 12 and includes a user-supported portion connected to the closed, support-loop portion 32.

More specifically, with respect to the first embodiment of the invention shown in FIGS. 1-4, the user-supported portion includes a closed, handle-loop 34 connected to the closed, support-loop portion 32. To use the first embodiment of the invention, a pair of skates 13 is obtained. One end of the article-engaging strap assembly 12 is threaded through the closed, support-loop portion 32 of the support strap assembly 30. The first strap-length adjustment assembly 24 is adjusted so that when the article-engaging strap assembly 12 is placed around the pair of skates 13, the pair of skates 13 are secured tightly together when the first article-engaging-strap connector 16 and the second article-engaging-strap connector 20 are connected together as shown in FIGS. 1-3. The article carrier strap apparatus 10 and the secured pair of skates 13 can be carried by a person grasping the closed, handle-loop 34.

A second embodiment of the invention is shown in FIGS. 5-8. In this embodiment, the user-supported portion of the support strap assembly includes an adjustable-length, support-loop-portion-supporting assembly 35. The adjustable-length, support-loop-portion-supporting assembly 35 includes a first closed supporting end 40, a first support-loop connector 42 attached to the first closed-support-loop-portion supporting end 40, a second closedsupport-loop-portion supporting end 44, a second support-loop connector 46 connected to the second closed-support-loop-portion supporting end 44, a middle closed-support-loop-portion supporting strap portion 48 located between the first closed-support-loop-portion supporting end 40 and the second closed-support-loop-portion supporting end 44, and a strap-length adjustment assembly 50 located in the middle closed-support-loop-portion supporting strap portion 48.

The adjustable-length, support-loop-portion-supporting assembly 35 can be used in two different modalities. As shown in FIGS. 5 and 6, the adjustable-length, support-loop-portion-supporting assembly 35 can be used as a single shoulder strap. As shown in FIGS. 7 and 8, the adjustable-length, support-loopportion-supporting assembly 35 can be used has a hands-free, double shoulder strap.

More specifically, for using the adjustable-length, support-loop-portion-supporting assembly 35 in either modality, one end of the article-engaging strap assembly 12 is passed through the closed, support-loop portion 32 of the support strap assembly 30. Then, the article-engaging strap assembly 12 is secured to the pair of skates 13 as described above for the first embodiment of the invention. With respect to the shoulder strap as shown in FIGS. 5 and 6, either the strap-length adjustment assembly 50 is adjusted for comfort. More specifically, the distance is adjusted between the pair of skates 13 and the topmost portion of the middle closed-support-loop-portion supporting strap portion 48 of the adjustable-length, support-loop-portion-supporting assembly 35.

In addition, the middle article-engaging-strap portion 22 of the articleengaging strap assembly 12 can include a slot portion 52. The slot portion 52 is located adjacent to either the first article-engaging-strap connector 16 or to the second article-engaging-strap connector 20.

To use the second embodiment of the invention in the hands-free mode shown in FIGS. 7 and 8, the second closed-support-loop-portion supporting end 44 of the adjustab-length, support-loop-portion-supporting assembly 35 is passed through the slot portion 52, and two loops are formed in the middle closed-support-loop-portion supporting strap portion 48. The two loops are approximately the same size. With this mode, each of a wearer's arms can be placed through one of the loops, and each loop can be placed on one of the wearer's shoulders. In this way, the wearer can have the pair of skates 13 supported in a hands-free manner from the wearer's shoulders. The pair of skates 13 can hang against either the front or the back of wearer as desired.

It is noted that, in fabricating the article carrier strap apparatus 10, the first article-engaging-strap end 14, the middle article-engaging-strap portion 22, the second article-engaging-strap end 18, and the slot portion 52 of the article-engaging strap assembly 12 can be made from a single, continuous strap. Stitches 54 can be sewn to fasten a free end portion of the middle article-engaging-strap portion 22 to a mid-portion of the middle article-engaging-strap portion 22. Stitches 56 can be used to form a loop to fasten the second article-engaging-strap connector 20 onto the second article-engaging-strap end 18 of the article-engaging strap assembly 12. In this way, the slot portion 52 is defined by the portion of the article-engaging strap assembly 12 between the stitches 54 and the stitches 56.

With the first embodiment of the invention, the closed, support-loop portion 32 and the closed, handle-loop 34 can be formed from a single strap. Free ends of the strap can be sewn together with stitches 58 to provide a small closed loop forming the closed, support-loop portion 32 and to provide a larger closed loop forming the closed, handle-loop 34.

With the exception of the first support-loop connector 42, the second support-loop connector 46, and the strap-length adjustment assembly 50, the adjustable-length, support-loop-portion-supporting assembly 35 of the second embodiment of the invention can be formed from a single strap with stitches 60 segmenting the strap into the closed, support-loop portion 32. A closed loop for retaining the first support-loop connector 42, and a closed loop for retaining the strap-length adjustment assembly 50.

The components of the article carrier strap apparatus of the invention can be made from inexpensive and durable cloth, metal, and plastic materials.

As to the manner of usage and operation of the instant invention, the same is apparent from the above disclosure, and accordingly, no further discussion relative to the manner of usage and operation need be provided.

It is apparent from the above that the present invention accomplishes all of the objects set forth by providing a new and improved article carrier strap apparatus that is low in cost, relatively simple in design and operation, and which may advantageously be used to permit a pair of footwear to be carried side by side. With the invention, an article carrier strap apparatus is provided which binds a pair of footwear together so that each of the pair of footwear does not swing independently of the other. With the invention, an article carrier strap apparatus is provided which does not include a pair of individual skate-carrier loops located at the far end of a straight strap. With the invention, an article carrier strap apparatus is provided which optionally can be used for carrying articles by hand, for carrying articles using one's shoulder, and for carrying articles in a hands-free manner.

Thus, while the present invention has been shown in the drawings and fully described above with particularity and detail in connection with what is presently deemed to be the most practical and preferred embodiment(s) of the invention, it will be apparent to those of ordinary skill in the art that many modifications thereof may be made without departing from the principles and concepts set forth herein, including, but not limited to, variations in size, materials, shape, form, function and manner of operation, assembly and use.

Hence, the proper scope of the present invention should be determined only by the broadest interpretation of the appended claims so as to encompass all such modifications as well as all relationships equivalent to those illustrated in the drawings and described in the specification.

Finally, it will be appreciated that the purpose of the foregoing Abstract provided at the beginning of this specification is to enable the U. S. Patent and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

What is claimed as being new and desired to be protected by Letters Patent of the United States is as follows:

1. An article carrier strap apparatus comprising:

an article-engaging strap assembly which includes a first article-engaging-strap end, a first article-engaging-strap connector attached to the first article-engaging-strap end, a second article-engaging-strap end, a second articleengaging-strap connector connected to the second articleengaging-strap end, a middle article-engaging-strap portion located between the first article-engaging-strap end and the second article-engaging-strap end, and a first strap-length adjustment assembly located in the middle article-engaging-strap portion;

a support strap assembly for supporting the article-engaging strap assembly, wherein the support strap assembly includes a closed, support-loop portion for supporting the middle article-engaging-strap portion of the article-engaging strap assembly and includes a user-supported portion connected to the closed, support-loop portion;

wherein the middle article-engaging-strap portion freely extends through the closed, support-loop portion of the support strap assembly to allow the support strap assembly to be freely positioned at any point along the middle article-engaging-strap portion of the article-engaging strap assembly, whereby the support strap assembly can be freely positioned along the middle article-engaging-strap portion of the article-engaging strap assembly proximal to the first article-engaging-strap end so as to reside proximal to a rear portion of a pair of skates when the article carrier strap apparatus is secured about the skates, and further whereby the support strap assembly can be freely positioned along the middle article-engaging-strap portion of the article-engaging strap assembly proximal to the second article-engaging-strap end so as to reside proximal to a front portion of a pair of skates when the article carrier strap apparatus is secured about the skates.

2. The article carrier strap apparatus of claim 1, wherein the user-supported portion includes an adjustable-length, support-loop-portion-supporting assembly, wherein the adjustable-length, support-loop-portion-supporting assembly includes a first closed-support-loop-portion supporting end, a first support-loop connector attached to the first closed-support-loop-portion supporting end, a second closed-support-loop-portion supporting end, a second support-loop connector connected to the second closed-support-loop-portion supporting end, a middle closed-support-loop-portion supporting strap portion located between the first closed-support-loop-portion supporting end and the second closed-support-loop-portion supporting end, and a strap-length adjustment assembly located in the middle closed-support-loop-portion supporting strap portion.

3. An article carrier strap apparatus comprising:

an article-engaging strap assembly which includes a first article-engaging-strap end, a first article-engaging-strap connector attached to the first article-engaging-strap end, a second article-engaging-strap end, a second article-engaging-strap connector connected to the second article-engaging-strap end, a middle article-engaging-strap portion located between the first article-engaging-strap end and the second article-engaging-strap end, and a first strap-length adjustment assembly located in the middle article-engaging-strap portion;

a support strap assembly for supporting the article-engaging strap assembly, wherein the support strap assembly includes a closed, support-loop portion for supporting the middle article-engaging-strap portion of the article-engaging strap assembly and includes a user-supported portion connected to the closed, support-loop portion;

wherein the user-supported portion of the support strap assembly includes a middle closed-support-loop-portion supporting strap portion having first and second ends, with both the first and second ends being coupled relative to the support-loop portion of the support strap assembly, the middle closed-support-loop-portion supporting strap portion extending about the article-engaging strap assembly to form a double shoulder strap comprised of two loops of the middle closed-support-loop-portion supporting strap portion, whereby each of a wearer's arms can be placed through an individual one of the loops of the double shoulder strap formed from the middle closed-support-loop-portion supporting strap portion, and each loop can then be placed on an individual one of the wearer's shoulders.

4. The article carrier strap apparatus of claim 3, wherein the middle article-engaging-strap portion of the article-engaging strap assembly includes a slot portion, and the middle closed-support-loop-portion supporting strap portion extends through the slot portion to form the two loops, whereby a portion of the middle closed-support-loop-portion supporting strap portion located between the two loops is held within the slot portion and such portion of the middle closed-support-loop-portion supporting strap portion is prevented from sliding freely along the middle article-engaging-strap portion.

5. The article carrier strap apparatus of Claim 4, wherein the slot portion is located adjacent to one of the article-engaging-strap connectors, and the closed, support-loop portion of the support strap assembly is interposed between the slot portion and the one of the article-engaging-strap connectors so as to capture the closed, support-loop portion between the one of the article-engaging-strap connectors and the portion of the middle closed-support-loop-portion supporting strap portion extending through the slot portion.

* * * * *